United States Patent [19]

Ancrenaz

[11] Patent Number: 5,067,358

[45] Date of Patent: Nov. 26, 1991

[54] VIBRATING TABLE INSTALLATION FOR THE MANUFACTURE OF CONCRETE PRODUCTS

[75] Inventor: Daniel M. Ancrenaz, Bonneville, France

[73] Assignee: Etablissements Balbinot S.A., Bonneville, France

[21] Appl. No.: 531,931

[22] Filed: Jun. 1, 1990

[30] Foreign Application Priority Data

Jun. 2, 1989 [FR] France ..... 89 07564

[51] Int. Cl.[5] ..... B28B 1/08; B28B 7/22

[52] U.S. Cl. ..... 74/61; 74/87; 209/367; 366/128

[58] Field of Search ..... 74/61, 87; 173/49; 209/366.5, 367; 366/128

[56] References Cited

U.S. PATENT DOCUMENTS

| | | | |
|---|---|---|---|
| 2,958,227 | 11/1960 | Peterson | 74/61 |
| 3,076,549 | 2/1963 | Becker | 209/367 |
| 3,221,567 | 12/1965 | Brandt, Jr. | 74/87 |
| 3,233,474 | 2/1966 | Ross et al. | 74/87 |
| 3,271,012 | 9/1966 | Van Bael | 74/87 |
| 3,332,293 | 7/1967 | Austin et al. | 74/61 |
| 3,465,599 | 9/1969 | Hinnecke et al. | 74/61 |
| 3,780,510 | 12/1973 | Tompkins | 74/87 X |
| 4,196,637 | 4/1980 | Banot et al. | 74/61 |

FOREIGN PATENT DOCUMENTS

| | | | |
|---|---|---|---|
| 3611219 | 10/1987 | Fed. Rep. of Germany | 74/87 |
| 2384555 | 11/1978 | France | 209/367 |

*Primary Examiner*—Leslie A. Braun
*Assistant Examiner*—Scott Anchell
*Attorney, Agent, or Firm*—Collard, Roe & Galgano

[57] ABSTRACT

Four shafts fitted with eccentric weights are arranged as four parallel lines with one pair placed immediately above the other pair and the ends of each are fitted with a notched driving roller. A double-notched belt driven by a motor passes alternatively under and above the rollers for the first pair of shafts, around a return, and above and under the rollers for the second pair of shafts. Idler rollers are associated with each shaft to ensure that the belt moves properly. By means of a slide, the motor and the return can be moved laterally in relation to the shaft lines, thereby permitting the continuous adjustment of the relative position of the eccentric weights for each pair of shafts. Therefore, the level of the resulting force of vibration is adjustable to between a maximum value and a zero value.

9 Claims, 7 Drawing Sheets

VIBRATING TABLE INSTALLATION FOR THE MANUFACTURE OF CONCRETE PRODUCTS

BACKGROUND OF THE INVENTION

1. Field of the Invention

This invention pertains to vibrating tables used as equipment on the presses utilized in the manufacturing of concrete products such as, for example, paving material, blocks, curbs, and other items.

2. Description of the Prior Art

Conventional presses are generally equipped with a concrete vibration device which is itself conventional and consists of a single table driven in a vertical direction by vibrators which use eccentric weights, which in turn are synchronized, and are rotated by motors, particularly electrical motors.

In these devices, the force of the unidirectional vertical vibration cannot be adjusted other than by the rotational speed of the eccentric weights during the course of the various phases of the vibration cycle of the manufacturing process for a product. Thus, the level of the vibrational force, the range of movement of the table, and the acceleration applied to the mould and the concrete which it contains, are determined solely by the single rotational speed. This speed is possibly subject to modification, but is always permanently set, and cannot be adjusted in any other manner.

Since the machines are almost always multi-purpose, they are designed to produce a very wide range of products. Quite often it is impossible to achieve favorable production conditions for different products, both with respect to quality of the product and with respect to an optimal length of time for the production cycle.

Disadvantages of the current state of the prior art are that the adjustments made with respect to certain phases of production (pre-vibration time, number of pulses by the filling compartment agitator, or even the duration of final vibration) are insufficient and inadequate.

It was concluded that action must be taken with respect to the prior art vibration devices themselves, since they have too many limitations and inadequacies. These prior art devices should be modified and improved to comply with the requirements for the production of a certain level of quality, using optimal conditions which reduce the final cost.

It is often the case with conventional facilities that, with an average complete cycle of 10 to 15 seconds, the length of the pre-vibrational and vibrational phases is on the order of one-third of the length of the complete cycle. The process consists of starting the motors, possible stopping, and shutdown before re-starting and again stopping in order to produce the vibration itself.

Between these two phases, only the rotation speed for the shafts bearing the eccentric weights undergoes a change, while the conditions for the remainder of the process are unaltered.

With an operating time of one minute, the need arises for a dozen, if not more, start and stop phases, and the power supply that is installed is extremely important. The solution, which would consist of using variable vibration speeds, which are independent of the system of motors, would involve enormous speed regulators. Existing regulators are, moreover, not designed for such a function.

Given these inadequacies of the prior art apparatus, it was proposed that adjustable weights be positioned on the rotating shaft. However, due to the conditions of vibration, play quickly developed in the adjustable connection for the weights on the shaft and, due to the desirability of extended service life, this solution has been ruled out due to reduced service life.

A staggering of the weights or eccentric weights by means of cluster and spider gears lubricated by oil baths located within housings was also proposed in the prior art. This technique considerably limits the rotational speed of the shafts bearing the weights or eccentric weights. Also, the maximum vibration frequency achieved in this manner is not compatible with the production of very compact products such as curbs and paving materials, for which a frequency of 75 Hz (or 4500 revolutions/minute) is the required minimum.

SUMMARY OF THE INVENTION

It is an object of the present invention to achieve by optimizing, in as simple a manner as possible, the physical conditions for the pre-vibrational phase, whose fundamental purpose is to fill the molds properly, and the vibrational phase itself, which is designed to ensure proper compacting of the material before final solidification.

It is another object to be able, during each phase, to take action with respect to the determining factors, other than the single speed of the eccentric weights, which are the force directly involved in acceleration, and the range of movement applied to the molds.

The above objects are accomplished in accordance with the present invention by providing a vibrating table installation for the manufacturing of concrete products, which comprises a vibrating table with a flexible mounting on a stand; shafts contained in housings connected to the table for vibrating said table, said shafts being equipped with eccentric weights, and said shafts being arranged as two pairs of shafts in four parallel lines with the first pair of shafts placed immediately above the second pair of shafts, each shaft carrying at one end a double-notched belt; at least one rotating cylinder motor for driving a belt, said motor being placed laterally with respect to the shafts and being parallel to the axis of the shafts; said belt passing alternatively under and above, or above and under, the rollers for the first pair of shafts, then around a return roller on an axis parallel to that of the motor and placed on the opposite side of the shafts from the motor, before again passing alternatively above and below, or below and above, the rollers for the second pair of shafts, and then returns to roll around the motor; and a slide for supporting the motor and the return roller, said slide being movable transversely in relation to the shafts in order to alter the relative angular position of the eccentric weights for each pair of shafts.

BRIEF DESCRIPTION OF THE DRAWINGS

Other objects and features of the present invention will become apparent from the following detailed description considered in connection with the accompanying drawings, which disclose a single embodiment of the present invention. It should be understood, however, that the drawings are designed for the purpose of illustration only, and not as a definition of the limits of the invention.

DETAILED DESCRIPTION OF THE PREFERRED EMBODIMENT

Figure 1:
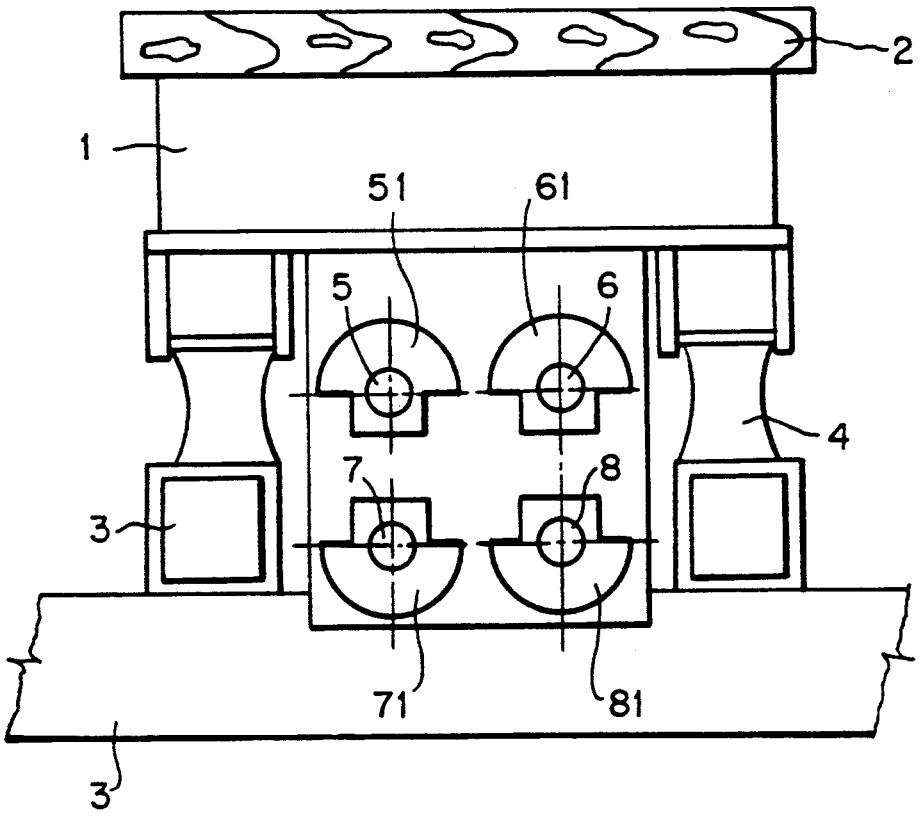
FIG. 1 shows an end view, as seen in the direction of line 1—1 of FIG. 2, of a vibrating table installation which is in accordance with the present invention.
Figure 2:
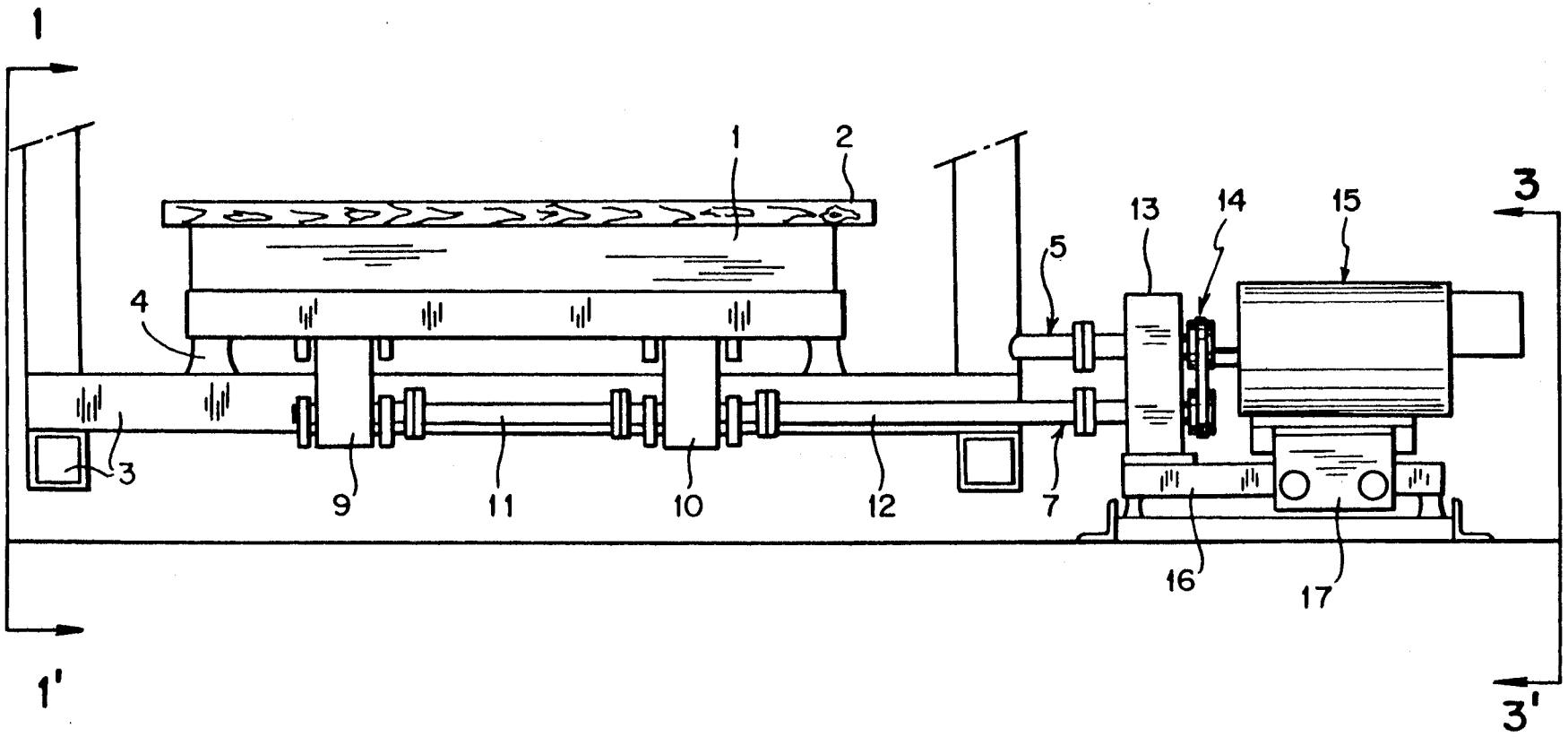
FIG. 2 shows a longitudinal side view of a vibrating table installation which is in accordance with the present invention.

Turning now in detail to the drawings, as can be seen particularly in FIGS. 1 and 2, the vibrating table 1, which is equipped with a molding board 2, is placed on a stand 3, with shock absorbers 4 between it and the stand.

According to the invention, the table 1 is vibrated by four shafts 5, 6, 7 and 8 which are arranged in vertically aligned pairs and equipped with weights or eccentric weights 51, 61, 71, 81 which are mounted on the shafts. The thrust bearings for these shafts are placed in two housings 9 and 10 which are axially displaced, and are equipped with roller bearings which are provided with oil splash lubrication in an oil bath. The housings 9 and 10 are mounted in a stationary manner on the lower side of the table 1. Between the two housings 9 and 10, each part of each shaft 5, 6, 7 and 8 is connected by means of a flexible drive using floating shafts 11, which is designed to withstand very severe conditions of stress and acceleration, as well as shocks. The ends of shafts 5, 6, 7 and 8 are also connected to a drive mechanism, which is described hereinafter, by means of a linkage which is also flexible.

In the present invention, the vibrational frequency is altered by manipulating the speed of shafts 5, 6, 7 and 8, without the need for repeated starts and stops. Also, the acceleration force of the vibration is altered by adjusting the relative positions of the eccentric weights 51, 61, 71, 81 likewise without the need for interrupting rotation during each pre-vibration/vibration cycle.

Figure 3:
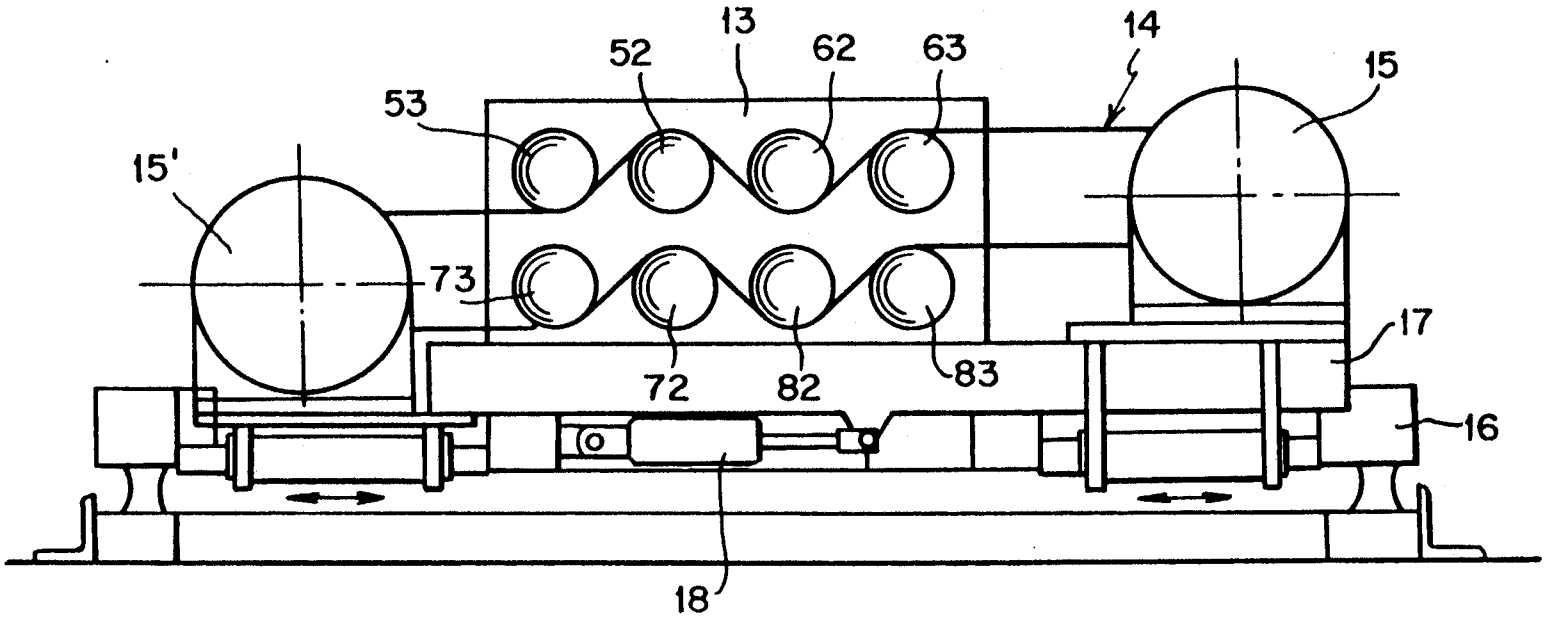
FIG. 3 shows an end view, as seen in the direction of line 3—3 of FIG. 2, of a vibrating table installation which is in accordance with the present invention.

As is better illustrated by FIGS. 2 and 3, each shaft 5, 6, 7 and 8, which is supported by a housing 13 which contains the necessary rotation roller bearings, is equipped with a notched drive roller 52, 62, 72, and 82. Each of these drive rollers, which are supported by a housing 13, is connected, on the same horizontal plane of the side external to shafts 5, 6, 7 and 8 to an idler roller 53, 63, 73, and 83 shown in FIG. 3. A double-notched belt 14 successively passes above and below each adjacent roller, as shown in FIG. 3. This belt 14 is designed to rotate the rollers 52, 62, 72, and 82 located on the shafts 5, 6, 7, and 8 and the idler rollers 53, 63, 73, and 83, which ensure an optimal rolling arc for the belt 14 in relation to the driving rollers 52, 62, 72, and 82.

There is at least one revolving cylinder engine 15, working in conjunction with a return roller 15'. Or there may be two motors 15 and 15', arranged axially at either side of the housing 13, preferably with their horizontal axes offset or staggered vertically, which will ensure a continuous drive and movement of the notched belt 14.

As can be seen, the path of the belt 14 in relation to drive rollers 52, 62, 72, and 82 and idler rollers 53, 63, 73, and 83 gives it a direction of rotation which is opposite at each level of the two levels of shafts 5, 6, 7, and 8. The resulting vibration applied to the table 1 is therefore unidirectional and vertical.

The motor 15 or motors 15 and 15', like the housing 13, is supported by a fixed chassis 16, completely independent of the stand 3 for the press. The motors (or motor and return roller) 15 and 15' are located on a slide 17 which can be moved axially in relation to the housing 13 and to the fixed chassis 16. This movement can be controlled by a jack 18.

By means of the jack 18, there is movement of the rotation axes of the motors 15 and 15' in relation to the housing 13. Thus, while keeping the center distance between the motor axes constant, movement of the jack creates a traction on the notched belt 14, which is in contact with the rollers, particularly driving rollers 52, 62, 72, and 82. This traction of the belt induces in the aforementioned rollers an angular displacement, and therefore creates an angular displacement in relation to the eccentric weights carried by the shafts located at the same level. This phase difference between the eccentric weights acts directly and independently of the rotational speed of the motors 15 and 15' on the vertical force of the resulting vibration. In this manner, the force can be adjusted in a continuous way between a maximum value for the position at one end of the slide 17 range of movement, and a zero value for the other end of the slide's range.

Figure 4A:
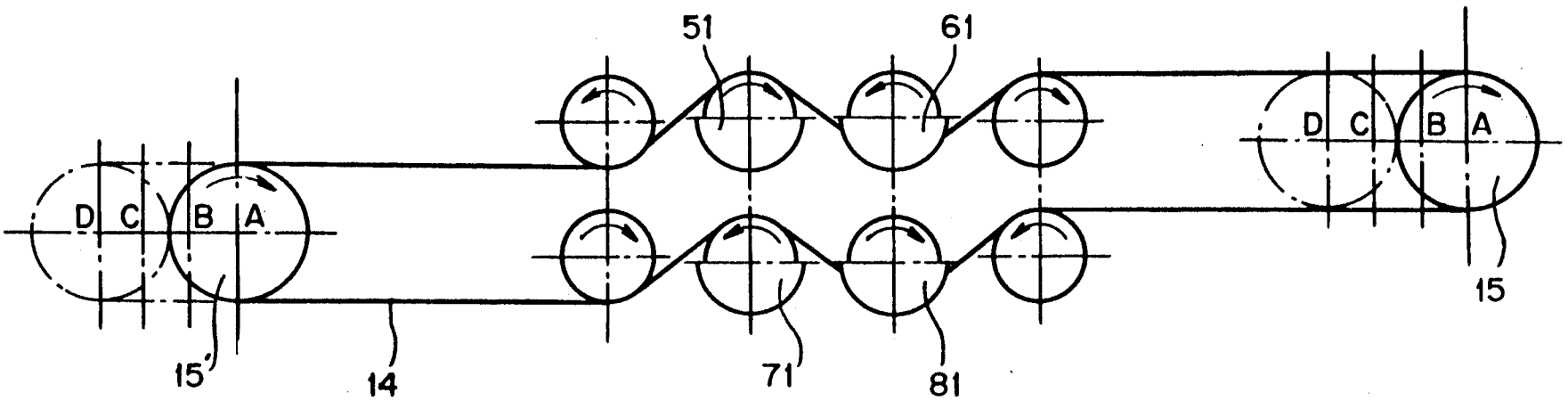
FIG. 4A shows a schematic illustration of the operation of the drive system for the installation of the invention.
Figure 4B:
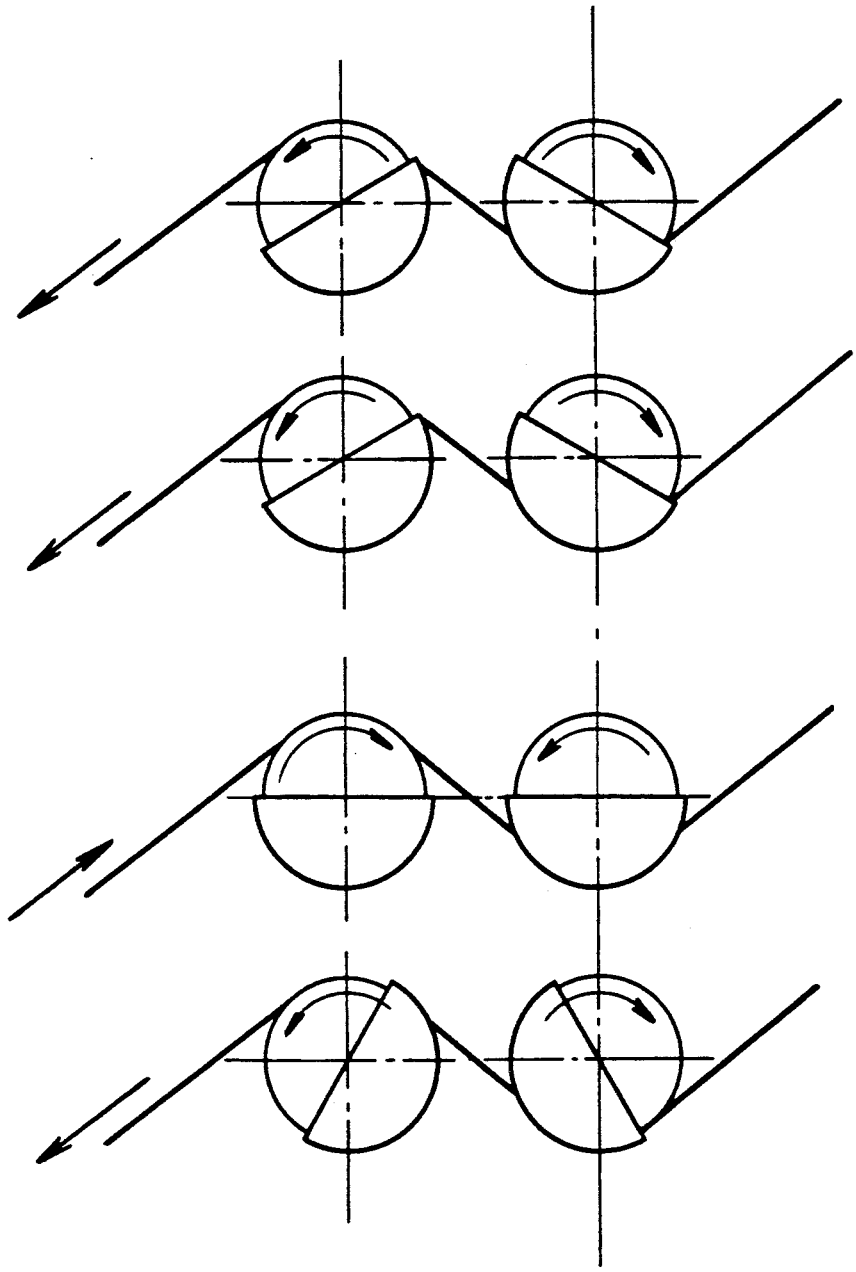
FIG. 4B shows a schematic illustration of the operation of the drive system for the same installation in position B, as shown in FIG. 4A.
Figure 4C:
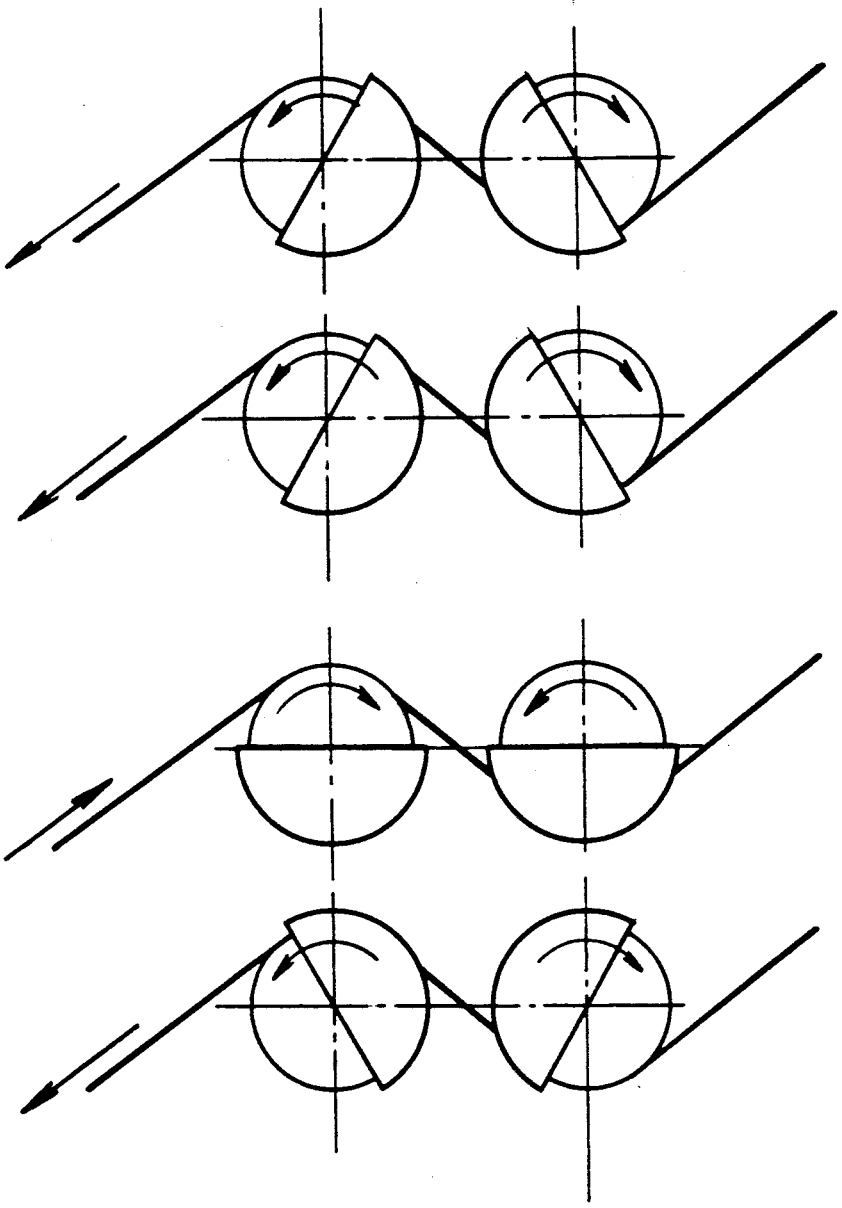
FIG. 4C shows a schematic illustration of the operation of the drive system for the same installation in position C, as shown in FIG. 4A.
Figure 4D:
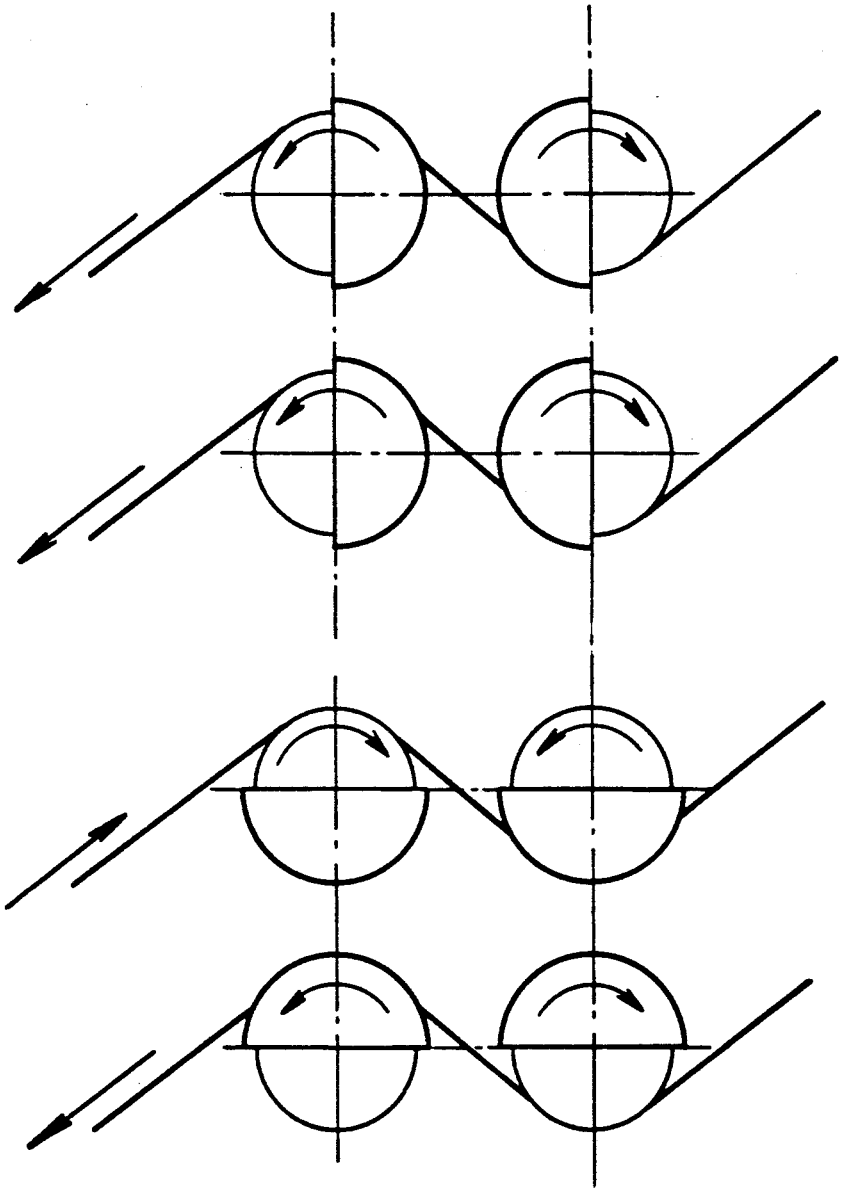
FIG. 4D shows a schematic illustration of the operation of the drive system for the same installation in position D, as shown in FIG. 4A.

FIGS. 4A and 4D give a schematic illustration of this effect, in which a maximum degree of vibration is achieved in position A of the slide, with a minimum level of vibration achieved in position D, with position C and position B corresponding to intermediate values. In FIG. 4A, the motors 15 and 15' are placed in rotation at the point in time at which the eccentric weights produce their maximum downward force. On the basis of the aforementioned position A, the upper portions of FIGS. 4B through 4D show what occurs during shifts to positions B, C, and D, respectively, due to the impact of the tension created in the notched belt (assuming that the motor is shut down, which is never necessary). The lower portions of FIGS. 4B through 4D illustrate the situation at a given moment during operation, but when movement to the corresponding position A, B, C, or D has already been accomplished.

From the foregoing, it can be seen that the present invention has the following advantages that include meeting the current requirements of industrial production: reliability, precision and performance. Synchronization of the rotation of the shafts with eccentric weights, which is provided by the notched belt, makes it possible to avoid the customary cluster gears, lubrication for which is not compatible with high rotation speeds and satisfactory length of service. In this instance, the housings which contain the bearings include only the special rollers necessary, since the eccentric weights are mounted outside the housings, on the ends of the connecting shafts.

The double notched belt requires no maintenance and it has a very long service life. The loads which it creates for the bearings are small and the maximum linear speed can be very high, so as to produce a vibration frequency which may reach 100 Hz. It also enables automatic control of the movement of the motors without mechanical devices other than the slide and jack, as well as rapid, precise movement which permits, during operation, continuous adjustment of the vibration force between a maximum and a zero value.

While only a single embodiment of the present invention have been shown and described, it is to be understood that many changes and modifications may be made thereunto without departing from the spirit and scope of the invention as defined in the appended claims.

What is claimed is:

1. A vibrating table installation for the manufacturing of concrete products comprising:

a vibrating table flexibly mounted on a stand;

shafts contained in housings connected to the table for vibrating said table, said shafts being equipped with eccentric weights, axes of said shafts being parallel, and said axes disposed such that a first pair of shafts lies in a first plane and a second pair of shafts lies in a second plane, said first plane and said second planes being parallel and spaced apart from one another, each shaft carrying at one end a notched drive roller;

at least one rotating cylinder motor for driving a double-sided notched belt, said motor having an axis parallel to said shafts and disposed in a third plane parallel to said first and second planes;

a return roller having an axis parallel to said shafts and disposed in a fourth plane parallel to said third plane, said return roller placed on the opposite side of said shafts from said motor;

said double-sided notched belt passing alternatively under and above, or above and under, the notched drive rollers for the first pair of shafts, then around said return roller, before passing alternatively respectively above and under, or under and above, the notched drive rollers for the second pair of shafts, and then returns to roll around the motor; and a slide for supporting the motor and the return roller, said slide being movable transversely in relation to the shafts in a fifth plane parallel to said third and fourth planes in order to alter the relative angular position of the eccentric weights for each pair of shafts.

2. The vibrating table in accordance with claim 1, wherein the return roller comprises a second motor.

3. The vibrating table in accordance with claim 1, further comprising notched idler rollers having axes parallel to the shafts so as to provide means for ensuring a suitable rolling arc for the belt as it moves over said notched drive rollers.

4. The vibrating table in accordance with claim 1, wherein said third plane and said fourth plane are spaced apart so as to provide means for ensuring rolling of the belt over the notched drive rollers.

5. The vibrating table in accordance with claim 1, further comprising a jack for controlling the movement of the slide.

6. The vibrating table in accordance with claim 1, wherein said eccentric weights are mounted on the shafts outside said housings.

7. The vibrating table in accordance with claim 1, wherein each shaft is comprised of plural parts and a flexible drive connects each notched drive roller with the associated eccentric weights which are connected with a floating shaft.

8. The vibrating table in accordance with claim 1, wherein a flexible drive connects the notched drive rollers to the eccentric weights.

9. The vibrating table in accordance with claim 1, further comprising a support housing on the stand for supporting the notched drive rollers.

* * * * *